US009555860B1

(12) United States Patent
Mackro

(10) Patent No.: US 9,555,860 B1
(45) Date of Patent: Jan. 31, 2017

(54) BRIDGE AND FABRIC KIT CONFIGURABLE INTO A HAMMOCK OR A PLATFORM EXTENDING BETWEEN TWO WATERCRAFTS TO FORM A MULTIPLE WATERCRAFT APPARATUS USING AN ASSEMBLY METHOD

(71) Applicant: Douglas V. Mackro, Higganum, CT (US)

(72) Inventor: Douglas V. Mackro, Higganum, CT (US)

( * ) Notice: Subject to any disclaimer, the term of this patent is extended or adjusted under 35 U.S.C. 154(b) by 0 days.

(21) Appl. No.: 14/736,430

(22) Filed: Jun. 11, 2015

Related U.S. Application Data

(60) Provisional application No. 62/012,075, filed on Jun. 13, 2014.

(51) Int. Cl.

| | |
|---|---|
| ***B63B 3/08*** | (2006.01) |
| ***B63B 17/00*** | (2006.01) |
| ***B63B 7/06*** | (2006.01) |
| ***B63B 27/00*** | (2006.01) |

(52) U.S. Cl.
CPC . *B63B 3/08* (2013.01); *B63B 7/06* (2013.01); *B63B 17/00* (2013.01); *B63B 27/00* (2013.01); *B63B 2003/085* (2013.01)

(58) Field of Classification Search
CPC ..... B63B 17/00; B63B 1/00; B63B 1/12; B63B 7/00; B63B 7/04; B63B 7/08; B63B 7/085;B63B 15/00; B63B 15/02; B63B 1/10; A45F 3/00; A45F 3/22
USPC ..... 114/347, 364, 39.26, 61.2, 61.23, 61.25,114/362; 441/129, 130
See application file for complete search history.

(56) References Cited

U.S. PATENT DOCUMENTS 4,813,366 A * 3/1989 Elder ..... B63B 1/04 114/290
2004/0049848 A1* 3/2004 Boyd ..... B63B 29/04 5/120

* cited by examiner

*Primary Examiner* — Lars A Olson
(74) *Attorney, Agent, or Firm* — Ware, Fressola, Maguire & Barber LLP

(57) ABSTRACT

A kit is provided to attach two or more boats together either at shore or while in deep water without exiting either boat so the two watercraft function as one, separated by a constant stable distance. A hammock may be stretched between the two boats with hooks and straps. When the hammock is allowed to extend below the surface of the water, ease of entry into and exit from the water is assured. When the hammock is stretched tightly between the boats, a stable, dry platform is provided for items such as fishing supplies, hunting equipment, coolers, camera equipment, etc. An adjustable or fixed distance may be provided between boats for different uses of the hammock.

18 Claims, 7 Drawing Sheets

BRIDGE AND FABRIC KIT CONFIGURABLE INTO A HAMMOCK OR A PLATFORM EXTENDING BETWEEN TWO WATERCRAFTS TO FORM A MULTIPLE WATERCRAFT APPARATUS USING AN ASSEMBLY METHOD

BACKGROUND OF THE INVENTION

A multi-purpose bracket which clamps across both gunwales of a canoe and presents a standardized pad at each side of the hull to align precisely and mount rigidly a variety of accessories is known from U.S. Pat. No. 5,501,169. These accessories include multi-hull catamaran coupling bars, portaging wheels, and any other equipment requiring a temporary but strong and secure means of attachment. In particular, see FIG. 8 thereof with two canoes coupled together in a catamaran configuration by a coupling bar assembly.

Similarly, a watercraft attachment device is known from U.S. Pat. No. 8,074,593 in which two watercrafts are joined using a first pair of parallel tubes that are parallel to the watercrafts and a second pair of parallel tubes that are perpendicular to and adjoin the first pair of parallel tubes and are hooked with hook attachments extending from each corner over a lip of each cockpit within the watercrafts to connect the watercrafts and then may include tensioning cords to tighten the hook attachments to secure the watercraft attachment device in place.

A canoe platform is known from U.S. Pat. No. 6,725,798 that interconnects a pair of spaced apart canoes arranged parallel with each other so that the platform can support human activity while the canoes support the platform above the water. The platform is made of a pair of panels adjoining each other and spanning the gunwales of the canoes and the space between them.

SUMMARY OF THE INVENTION

According to a first aspect of the present invention, a kit is provided for connecting two watercrafts together, the kit comprising:

two structural elements extendable between the two watercrafts and connectable at respective ends thereof to the watercrafts so the two watercrafts are fixedly separated; and a fabric connectable to the two watercrafts along opposite edges of the fabric, the fabric being stretchable into a platform configuration with the fabric entirely above a waterline between the watercrafts when the watercraft are fixedly separated, or the fabric being drapeable into a hammock configuration between the watercraft when fixedly separated with part of the fabric below the waterline.

In accordance with the first aspect of the present invention, the kit may further comprise brackets attachable to the watercrafts and that, once attached to the watercrafts, are attachable to respective ends of the structural elements when extended between the watercrafts so the two watercrafts are fixedly separated.

In further accordance with the first aspect of the present invention, the structural elements are adjustable to accommodate different distances between watercrafts so as to stretch the fabric into the platform configuration at one distance or to drape the fabric into the hammock configuration at another distance.

In still further accord with the first aspect of the present invention, the kit further comprises adjustable straps extendable within the fabric to the respective opposite edges thereof and connectable to the two watercrafts to accommodate the fabric being stretchable into the platform configuration with the fabric entirely above a waterline between the watercrafts, or the fabric being drapeable into the hammock configuration between the watercraft with part of the fabric below the waterline.

According to a second aspect of the invention, a kit is provided for connecting two watercrafts together comprising:

two structural elements extendable between the two watercrafts and connectable at respective ends thereof to the watercrafts so the two watercrafts are fixedly separated, and brackets attachable to the watercrafts and that, once attached to the watercrafts, are attachable to the respective ends of the structural elements when extended between the watercrafts so the two watercrafts are fixedly separated.

In accordance with the second aspect of the invention, the kit may further comprise a fabric connectable to the two watercrafts along opposite edges of the fabric, the fabric being stretchable into a platform configuration with the fabric entirely above a waterline between the watercrafts when the watercraft are fixedly separated, or the fabric being drapeable into a hammock configuration between the watercraft when fixedly separated with part of the fabric below the waterline; and adjustable straps extending within the fabric to the respective ends thereof and connectable to the two watercrafts to accommodate the fabric being stretchable into the platform configuration with the fabric entirely above a waterline between the watercrafts, or the fabric being drapeable into the hammock configuration between the watercraft with part of the fabric below the waterline.

In further accordance with the second aspect of the invention, the structural elements may be adjustable to accommodate different distances between watercrafts so as to stretch a fabric into a platform configuration at one distance or to drape the fabric into a hammock configuration at another distance.

According to a third aspect of the invention, a kit is provided for connecting two watercrafts together comprising:

brackets attachable to the watercrafts and that, once attached to the watercraft, are attachable to respective ends of structural elements when extended between the watercrafts so the two watercrafts are fixedly separated; and a fabric connectable to the two watercrafts along opposite edges of the fabric, the fabric being stretchable into a platform configuration with the fabric entirely above a waterline between the watercrafts when the watercraft are fixedly separated, or the fabric being drapeable into a hammock configuration between the watercraft when fixedly separated with part of the fabric below the waterline.

In accordance with the third aspect of the present invention, the kit may further comprise adjustable straps extending within the fabric to the opposite edges thereof and connectable to the two watercrafts to accommodate the fabric being stretchable into the platform configuration with the fabric entirely above a waterline between the watercrafts, or the fabric being drapeable into the hammock configuration between the watercraft with part of the fabric below the waterline.

According to a fourth aspect of the present invention, a method is provided, comprising:

attaching two or more small, personal watercrafts together by means of structural bars, and connecting a fabric between the two watercrafts with links such that the fabric is extendable below water in a hammock configuration of the fabric to allow for an ease of entry into and exit from the water for a swimmer, and such that the fabric is stretchable tightly between the watercrafts, to provide an above water platform configuration of the fabric.

In accordance with the fourth aspect of the invention, the method may further comprise adjusting the structural bars to effect different distances between watercrafts.

According to a fifth aspect of the present invention, a method is shown for attaching two or more small, personal watercrafts, such as row-boats, kayaks, or canoes together, in any combination, by means of structural bars. The attachment and detachment will be able to be accomplished either at shore or while in deep water without exiting either watercraft. When the attachment is accomplished, the two watercrafts will function as one, remain separated by a constant distance between them, and become more stable as a result of the connection furnished by the structural bars which act as a bridge.

In accordance with the fifth aspect of the present invention, a fabric may be stretched between the two watercrafts connected via such a bridge or between a watercraft and an integrated outrigger by means of links such as hooks and/or strap connections. When the fabric is allowed to extend below the surface of the water, a purpose may be to provide a hammock configuration of the fabric to allow for an ease of entry into and exit from the water for a swimmer. When the fabric is stretched tightly between the watercrafts, a purpose may be to provide a stable, dry platform configuration of the fabric between the watercrafts for supporting items above the waterline such as fishing supplies, hunting equipment, coolers, camera equipment, etc.

The bridge and fabric links can be adjustable or fixed to accommodate different distances between watercrafts or different use of the fabric.

According to a sixth aspect of the present invention, an apparatus is provided comprising:

two or more small, personal watercrafts connected together by means of structural bars; and a fabric connected between the two watercrafts with links such that the fabric is extendable below water in a hammock configuration of the fabric to allow for an ease of entry into and exit from the water for a swimmer, and such that the fabric is stretchable tightly between the watercrafts, to provide an above water platform configuration of the fabric.

In accordance with the sixth aspect of the invention, the structural bars are adjustable to effect different distances between watercrafts.

BRIEF DESCRIPTION OF THE DRAWINGS

FIG. 15 shows further detail of a pair of boats such as the kayaks shown in FIGS. 1 and 3 with an adjustable fabric stretched in between.

DETAILED DESCRIPTION OF THE INVENTION

Figure 1:
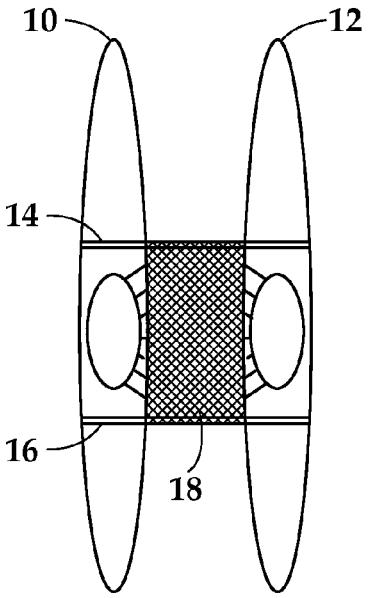
FIG. 1 shows a pair of kayaks or closed top boats interconnected by structural support bars acting as a fixed bridge between the two watercraft with a fabric stretched in between the two attached watercraft.
Figure 2:
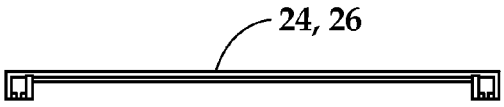
FIG. 2 shows a structural support bar with clamping ends that may be used to interconnect a pair of watercraft in order to form a part of the bridge shown in FIG. 1.

FIG. 1 shows two closed-top boats or watercraft 10, 12 attached together by means of two structural members or bars 14, 16 which may take the form, for instance, shown in FIG. 2 which is one potential embodiment of structural member, element, or bar with which to form a boat bridge. Each bar 24, 26 (only one is shown) has clamps at each end, i.e., clamping ends for clamping onto brackets (as in closed-top boats) or onto the outside gunwales (as in open-top boats). A fabric, woven mesh, or cloth 18 is attached for instance by hooks, straps or a combination of hooks and straps to the boat hulls and bridge structural support bars.

This may be done in such a way that the fabric is stretched tightly so as to provide a dry platform slightly below the level of the bridge support bars. The two structural support bars act as a fixed bridge between two or more boats when installed. In the embodiment shown in FIG. 1, the two watercrafts 10, 12 are kayaks and are shown with straps attached to the fabric hooked to the oval openings in the top or deck of the of kayaks.

The structural bars 14, 16 used to attach the fabric between the watercrafts may be adjustable in length so that with decreased length the fabric may be partially submerged beneath the water level between the watercraft into a hammock configuration. Thus, the fabric, mesh or cloth attached by hook and/or straps to the boat hull and bridge support bars may be draped long enough to hang beneath the water's surface. This may provide a convenient way for a person to exit the body of water after a swim and enter into one of the watercraft, for instance, one of the kayak openings as shown in the embodiment of FIG. 2. Adjustability in the structural bars may be provided for instance by a telescoping feature such as provided by collapsible telescopic legs in camera tripods or monopods. Such a bar may for instance have two parts, with one part capable of telescoping to adjust the length of the bar to suit the desired separation. Aluminum or steel slip joints with a tightening screw may be provided at the end of an outer part to hold the inner part in place and fix the length. Or, the bars may for instance be provided with a removable section in the middle or a removable section at one end or removable sections at both ends fixed by tightening screws.

Figure 4:
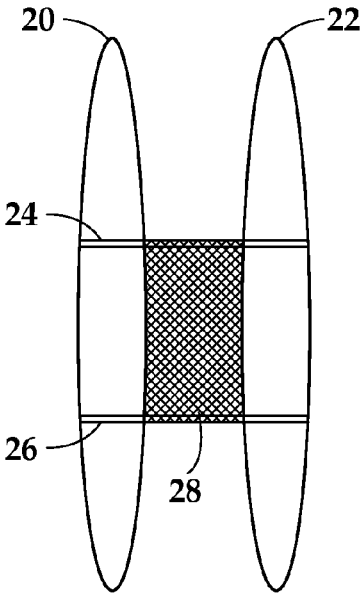
FIG. 4 shows a pair of canoes or open topped boats having two structural support bars acting as a fixed bridge between them with a fabric stretched taut between the two boats to serve as an above water platform in a platform configuration.
Figure 5:
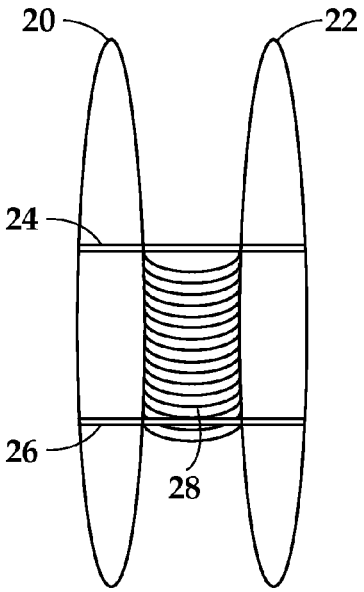
FIG. 5 shows the two watercraft of FIG. 4 with the fabric 1 inks or straps lengthened to cause the fabric to lie beneath the water line in a hammock configuration.
Figure 6:
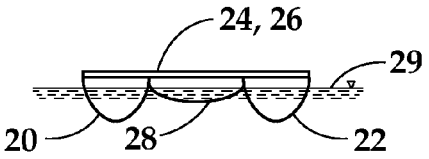
FIG. 6 shows a sectional view of the watercraft of FIG. 5 showing the fabric lying or hanging in part below the water line.
Figure 7:
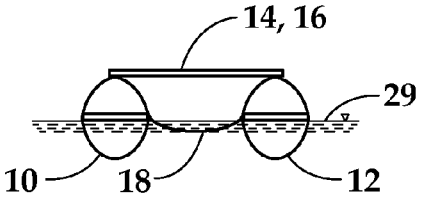
FIG. 7 shows the watercraft of FIG. 3 with the fabric lying or hanging in part below the water line.

The same principles are applicable to the embodiments of FIGS. 4 and 5 which show a fabric, mesh, or cloth fabric attached by hook or straps to open-top boat hulls and bridge support bars tightly in FIG. 4 and more loosely in FIG. 5 to respectively provide a platform stretched tautly above the waterline or a hammock hanging loosely beneath the waterline. FIG. 6 shows a cross-section of open-top watercrafts such as shown in FIG. 5 with the fabric of FIG. 5 extended between e.g. two canoes with the fabric under the water line 29 while FIG. 7 shows a fabric loosely hanging down between two kayaks with part of the fabric submerged below the waterline 29.

Figure 8:
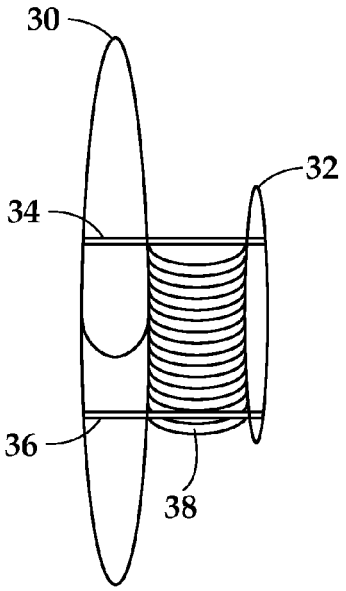
FIG. 8 shows a watercraft attached by structural support bars to an outrigger with a fabric stretched therebetween.

FIG. 8 shows a watercraft 30 attached to a catamaran type float 32 or outrigger by means of structural supports 34, 36 with a fabric 38 shown installed between the watercraft 30 and the outrigger 32. The illustrated fabric is draped long enough to hang beneath the waterline in the illustrated embodiment in a similar way as the drapings shown in FIGS. 3, 5, 6, and 7.

Figure 3:
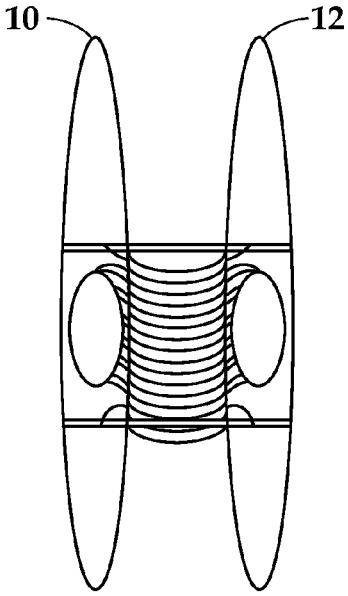
FIG. 3 shows the watercraft of FIG. 1 with adjustable links or straps lengthened so that the fabric hangs low between the boats and under the water line.
Figure 9:
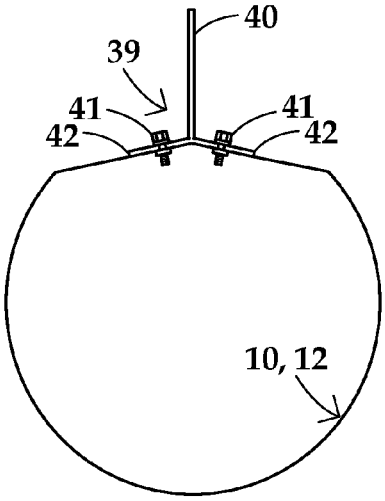
FIG. 9 shows a cross-section at the bracket location of a boat hull of a kayak or closed-top boat.
Figure 10:
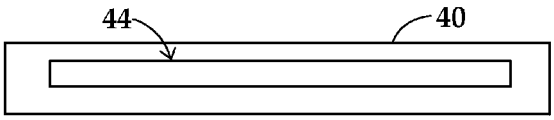
FIG. 10 shows a side view of a bracket with a cutout in the center for attachment of a structural bar.
Figure 11:
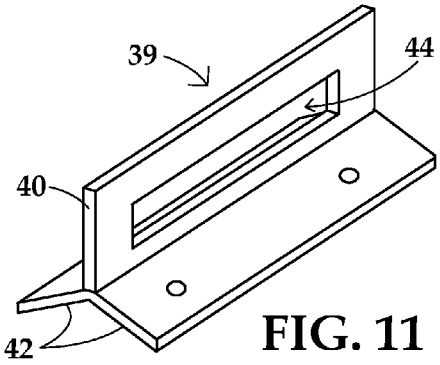
FIG. 11 shows a mounting bracket such as shown in FIG. 9 in a perspective view.
Figure 12:
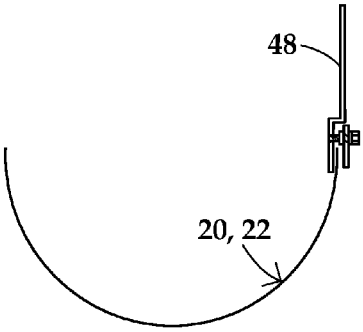
FIG. 12 shows a cross-section of an open-top boat such as a canoe with a mounting bracket suitable for attachment to a gunwale.
Figure 13:
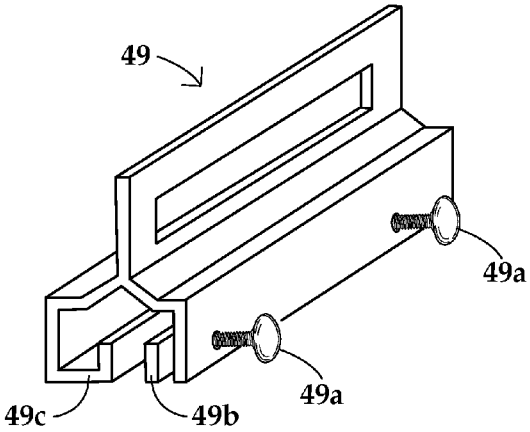
FIG. 13 shows another type of mounting bracket in perspective view such as might be attached to a gunwale of an open-top boat or watercraft as in FIG. 12.

As suggested above, for kayak or closed-top watercrafts such as shown in FIGS. 1 and 3, the structural support bars 14, 16 may be attached to structural brackets that are attached to the top deck with bolts such as the bracket 39 shown in FIG. 9 that shows a cross section at the bracket location on the boat hull 20, 22. A side view of the top part 40 of the bracket 39 with a cutout in the center is shown in FIG. 10. A perspective view of the bracket 39 is shown in FIG. 11. As will be apparent from FIG. 11, the bracket 39 may take the form of a vertical panel (top) part 40 attached to two base panels 42 that may for example be splayed as shown or that may in another embodiment lie flat (perpendicular to the vertical panel). Other configurations may be used depending on the shape of the hull. At least the ends of the structural support bars will then have a cross-section that is suited for insertion into or otherwise mates or matches the opening 44 in the top part 40 of the bracket 39. After insertion, mating, or the like, any kind of temporary fastening device or devices may be used to secure the end of the support member in or to the hole 44 of the top part 40 of the bracket 39. The entire structural member may for instance be a long, thin, and flat structural bar. The structural bar may be provided with through-holes separated by the thickness of the top part 40 of the bracket 39 so that temporary stops or dowels may be placed in the holes once the bar is inserted in place so as to hold the bar in position within the hole 44 in the top part 40 of the bracket 39. In lieu of a telescopic feature in the bars for providing adjustability, multiple pairs of such holes may be drilled in rows at various positions along the length of the bar towards the ends thereof so as to provide for user selection of the distance between the watercrafts. For the canoe or open-topped boat embodiments of FIGS. 4 and 5, a structural bar 24, 26 such as shown in FIG. 2 may be used, or a bracket such as shown in FIG. 10 may be used but with a different mounting bracket, such as shown in FIG. 12, with a mounting bracket 48 suitable for open-top boats being attached to a gunwale at the top edge of the hull 20, 22, as shown. It is also possible to use two brackets at each end of a given structural bar in each boat to provide added stability. Thus, for the open topped boat of FIG. 12 where only one bracket is shown, a mounting bracket 48 could be placed on both gunwales on opposite sides of the same hull and the structural bar would pass through openings 44 in both of the opposing brackets before being secured. FIG. 13 shows a mounting bracket 49 similar to that shown in FIG. 12 for supporting a structural bar as described. Screws 49*a* shown with heads extending through threaded holes on the side of the mounting bracket 49 may be thumb screws used to hand tighten the bracket onto the gunwale with a moveable pressure bar 49*b* shown inside the bracket that can be screwed tight onto one side of a gunwale against an opposing L-shaped or channel part 49*c* of the bracket on the other side of the gunwale.

The brackets of FIGS. 11 and 13 are merely representative hardware that are by no means the only ways of securing the structural supports such as bars between the watercrafts and other hardware may be used.

Figure 14:
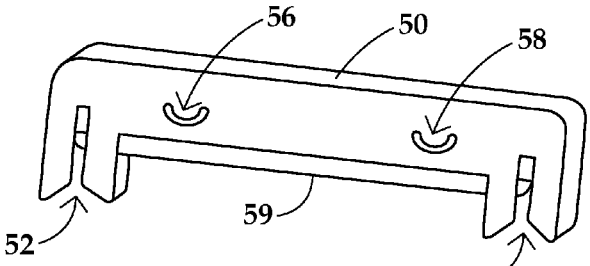
FIG. 14 shows another type of structural bar that may be attached with spring loaded latches to gunwales of open-top boats or to a bracket such as shown in FIG. 9 or 11 for a closed-top boat or as shown in FIG. 13 for an open-top boat.

Likewise, it may not be necessary to use separate brackets at all such as shown by the example of FIG. 2. Another such example is shown in FIG. 14 which shows a watercraft connecting bar 50 having spring loaded latches 52, 54 at opposite ends of the connecting bar. Hook rings 56, 58 may be provided in the sides of the watercraft connecting bar 54 for hooking hooks provided in the hammock. A latch release cord 59 may be provided to release the spring loaded latches 52, 54 when desired to remove the watercraft connecting bar.

Figure 15:
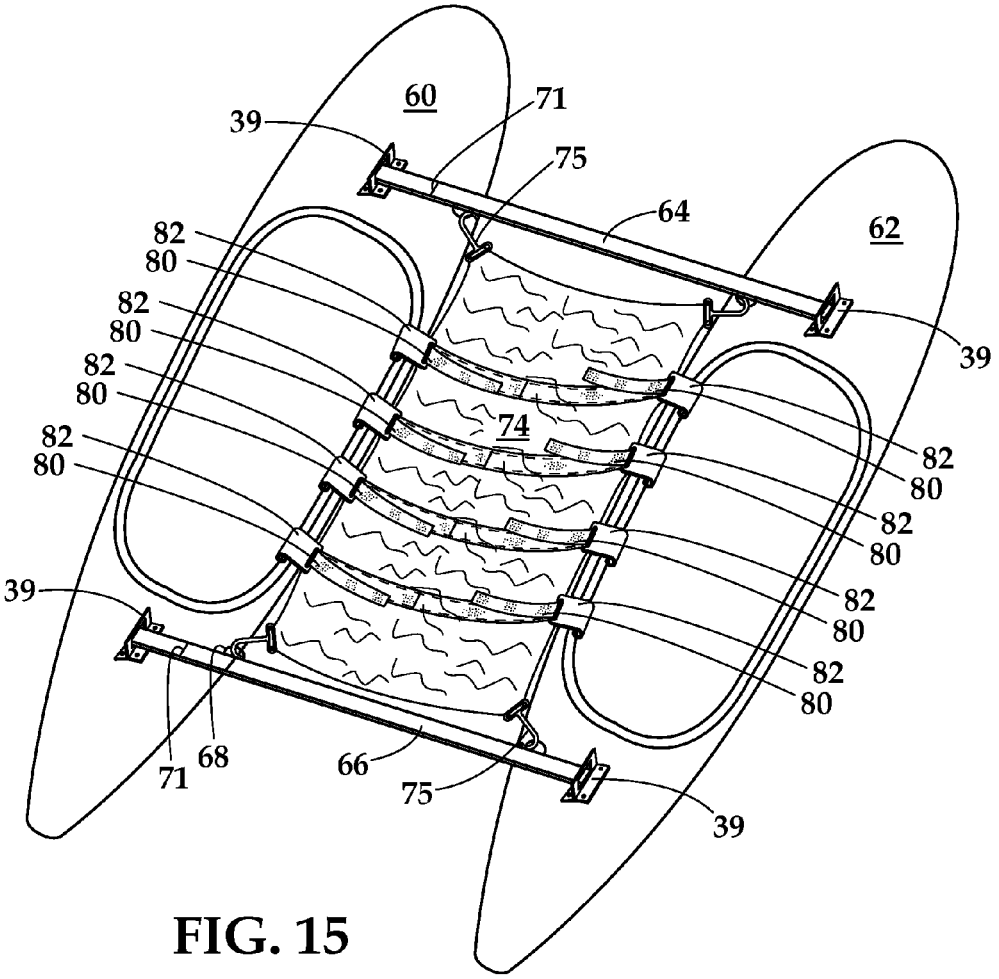

FIG. 15 shows a pair of kayaks or closed-top watercrafts 60, 62 connected by structural members or bars 64, 66 using e.g. mounting brackets 39 similar to the mounting brackets 39 shown in FIGS. 9-11. The structural support bars 64, 66 may be provided with hook mounting rings 68, 70 to which hooks may be attached through the loop provided by each ring which may take the form of a semi-circular ring or loop welded to or formed with or in the structural bars, for instance. Other types of attachment mechanisms may be used such as a simple hole or cavity through a hollow structural bar, if that is how the structural bar is constructed. Each bar may be provided with a length adjustability feature such as the ability to telescope one end into and out of the other as indicated by a line 71 near an end of each bar 64, 66.

Figure 16:
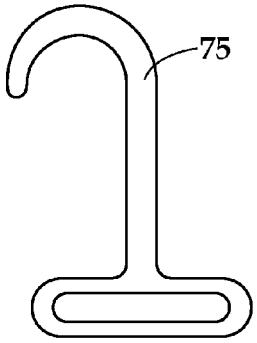
FIG. 16 shows a hook that may be used at the corners of an adjustable fabric to attach to eye loops on structural bars.
Figure 17:
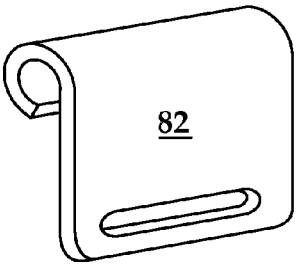
FIG. 17 shows a flat hook that may be used at the ends of straps for attaching sides of the fabric to gunwales or brackets.
Figure 18:
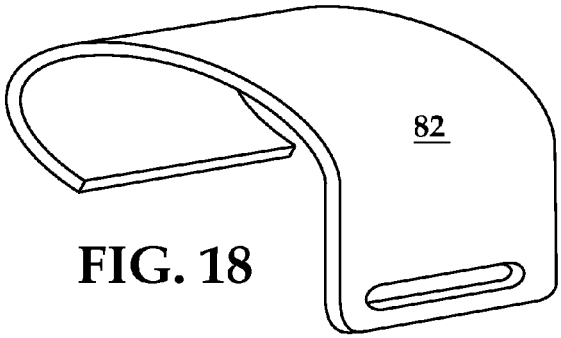
FIG. 18 shows a flat hook similar to that of FIG. 17 except with a bigger hooked end to fit wider gunwales or different types of bracket openings.

FIG. 15 also shows a fabric 74 stretched between the two kayaks 60, 62 and held in place at the ends thereof by straps near the corners that are terminated with hooks such as the hook 75 shown in FIG. 16 that may be hooked into the mounting loops 68, 70 on opposite ends of a bar 64, 66. The hooks may take any convenient form such as that shown or other types, for instance lobster clasps, closures, or hooks. These hooks as well as similar hooks on the other end of the fabric will serve to hold the corners of the fabric on to the structural bars 64, 68 by being hooked to the mounting rings 64, 68. The fabric may also be supported by a plurality of straps 80 that may be adjustable and that may be terminated with flat hooks such as shown in FIG. 17 or FIG. 18. The flat hook of FIG. 18 has a bigger end to fit both a narrow or a wide gunwale.

Figure 19:
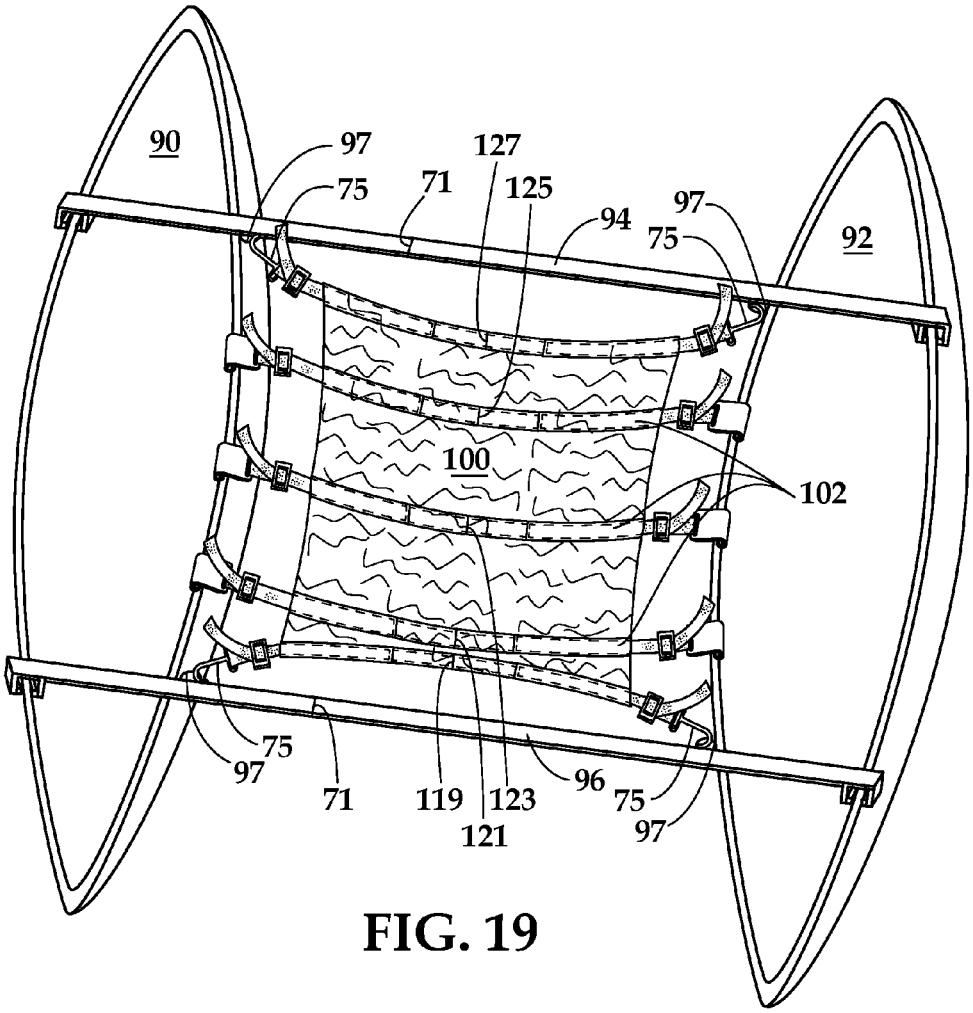
FIG. 19 shows an embodiment similar to the embodiments of FIGS. 4 and 5 showing more details of how an adjustable fabric may be stretched and connected to gunwales and structural bars interconnecting the boats such as the boats of FIGS. 4 and 5.

FIG. 19 shows a pair of canoe or open topped boats 90, 92 having two structural support bars 94, 96 acting as a fixed bridge between the two boats 90, 92. The structural bars 94, 96 may e.g. be of the type of bar 24, 26 shown in FIG. 2 that are able to clamp or attach to the edge of the boat or even to a mounting bracket such as the mounting bracket 48 shown in FIG. 12.

Similar to the embodiment shown in FIG. 15, eye loops 97 may be provided for fabric attachment by means of hooks such as shown in FIG. 16 at the corners of the fabric 100. As in FIG. 15, flat hooks such as shown in FIGS. 17 or 18 may be hooked over the gunwales or inserted in mounting brackets such as the mounting bracket 48 of FIG. 12 for attaching adjustable straps 102 in order to secure the side edges of the fabric to the respective watercrafts 90, 92. As with the embodiments of FIGS. 4 and 5, the straps may be adjusted e.g. by adjustable straps to pull the fabric tautly across the space between the two boats so as to create a platform configuration with the fabric entirely above-water or may be loosened with sufficient length to cause the fabric to droop below the water line and thereby provide a swimmer a way to climb aboard one of the boats without capsizing same. The fabric may for instance be made of nylon with an open mesh weave or of nylon small mesh netting. Strap adjustment hardware 93 is provided at ends of the adjustable straps 95. The adjustable straps may be attached to the nylon fabric or pass through sleeves in the fabric. A sleeve approach would allow the fabric the flexibility to slide with respect to the straps.

Figure 20:
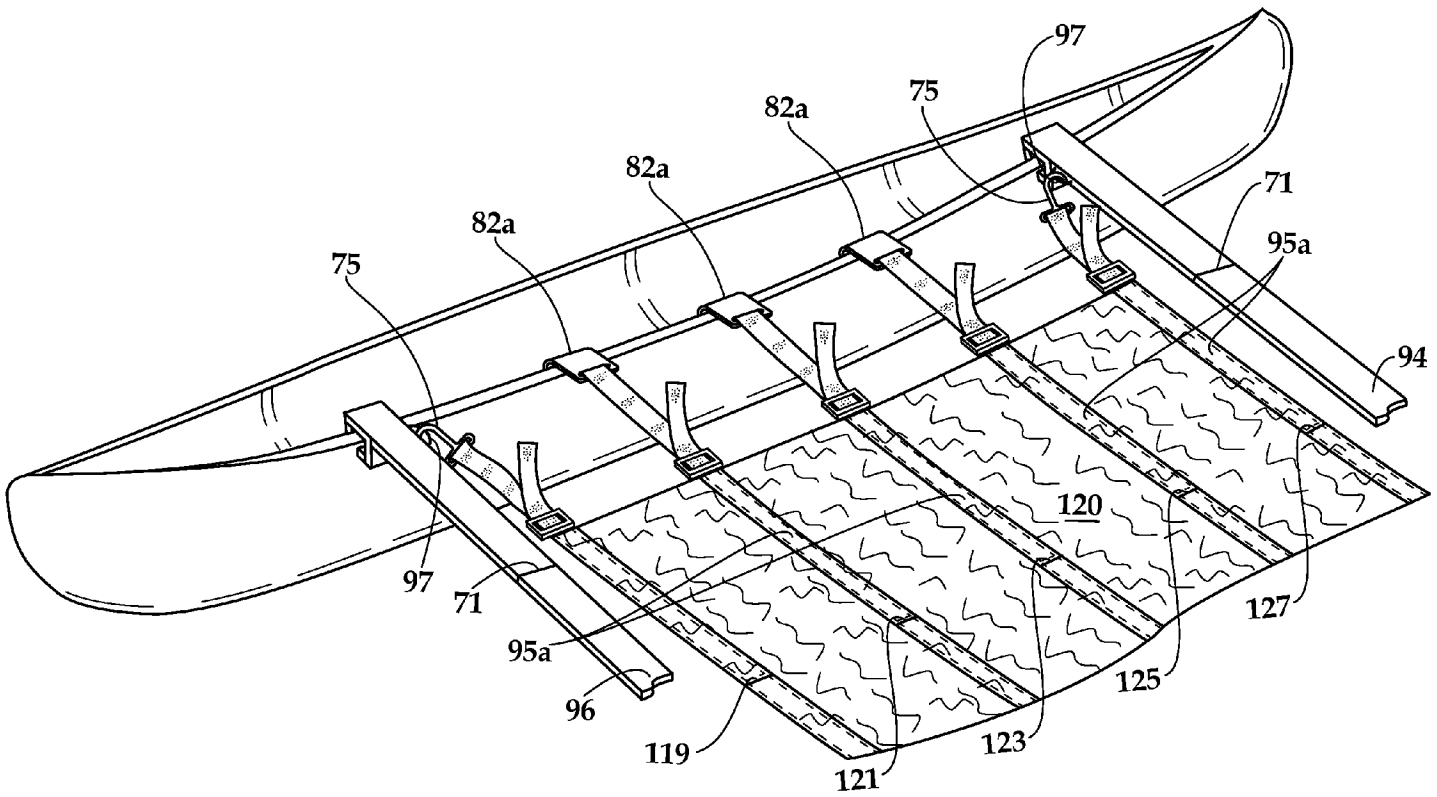
FIG. 20 shows further details of the embodiment of FIG. 19 with emphasis on the metal clamps that are adjustable and sleeves in the fabric for allowing the straps to slide with adjustability within the sleeves of the fabric.

FIG. 20 shows a fabric 120 with adjustable straps 95*a* attached by flat hooks to the gunwale of one of the boats of FIG. 19 with more detail shown of the adjustability of the straps. Each strap has an adjustable clasp or clamp which may be a metal clamp with part of the strap passing there through for the user to grasp and adjust the length of the strap when either lengthening or shortening same to create a drooping hammock configuration for the fabric or a taut platform configuration between the watercrafts. A coupling such as an adjustable strap assembly may include a buckle assembly that includes various slots and a strap. The strap assembly may also include a flat hook secured to the buckle assembly as shown. As mentioned above, the straps may be passed through sleeves sewn into the fabric and attached to the fabric inside the sleeve at a convenient point 119, 121, 123, 125, 127 to allow the fabric freedom of movement with respect to the strap within the sleeve when a given strap is either being shortened or lengthened. In other words, the fabric may be bunched up or stretched relative to the straps depending on the length chosen for the adjustable straps in the various hammock and platform configurations. FIG. 20 also shows end hooks hooked into eye rings of the support bars as previously described to support the corners of the fabric. It should be realized that many variations of the connections between the fabric, the watercrafts, and the structural supports are possible. For instance, the hooks used at the corners of the fabric may be fashioned as anchor parts of the structural bars to which adjustable buckles are attached. See for instance the hooked anchors shown in U.S. Pat. No. 5,170,521 built into the cabin of a truck to which belt buckles may be attached through a hole in the buckle.

Figure 21:
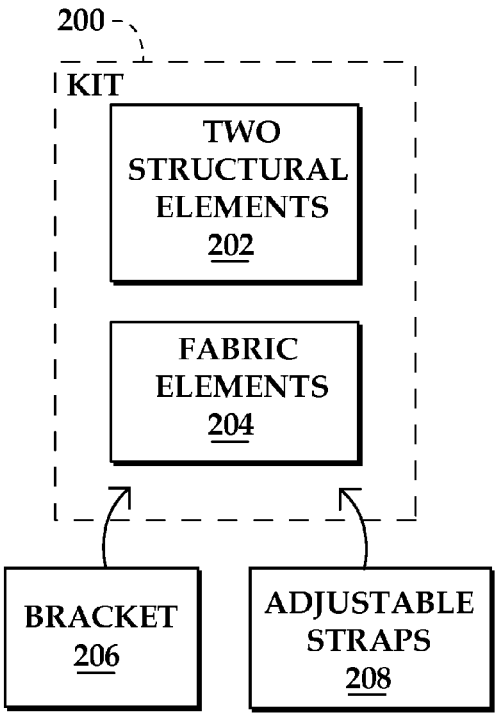
FIG. 21 shows a first version of a kit that is packaged for sale and use by a purchaser for connecting two watercrafts together.

FIG. 21 shows a first version of a kit 200 that is packaged for sale and use by a purchaser for connecting two watercrafts together. The kit may include a package such as a box such as made of wood or cardboard, a resealable fabric or plastic bag having contents for instance various components or elements 202, 204 placed within the bag or box for use by a purchaser in assembling an apparatus according to the methods taught herein. A first component or element 202 may include at least two structural elements that are extendable by the user between the two watercrafts and that are connectable at respective ends thereof to the watercrafts so the two watercrafts are fixedly separated. The kit 200 may also include a fabric element 204 connectable by the user to the two watercrafts along opposite edges of the fabric. The fabric may be formed so as to be stretchable by the user into a platform configuration with the fabric entirely above a waterline between the watercrafts when the watercrafts are fixedly separated. Or the fabric may be draped by the user into a hammock configuration between the watercraft when fixedly separated with part of the fabric below the waterline.

Although the kit 200 may be offered or sold without brackets such that the brackets would be packaged for sale separately, the kit 200 may further include brackets 206 that may be attached by the user to the watercrafts and that, once attached to the watercraft, may be attached to respective ends of the structural elements when extended between the watercrafts so the two watercrafts are fixedly separated.

The structural elements 202 may be adjustable as previously described to accommodate different distances between watercrafts so as to stretch the fabric into the platform configuration at one distance or to drape the fabric into the hammock configuration at another distance.

The kit 200 may further include adjustable straps 208 that may be made to extend within the fabric to the respective edges thereof and be connected to the two watercrafts to accommodate the fabric being stretched into the platform configuration with the fabric entirely above a waterline between the watercrafts, or the fabric being draped into the hammock configuration between the watercraft with part of the fabric below the waterline. The kit may provide means by which the straps may be attached 121, 123, 125, 127 by the user to the fabric 204 within the sleeves such as shown in FIG. 20, for instance at the midpoint of each sleeve. Such might for instance be thread and needle or a tie wrap that is threaded through a preformed, reinforced hole in the fabric midway between the edges, i.e., in the middle of each sleeve.

Figure 22:
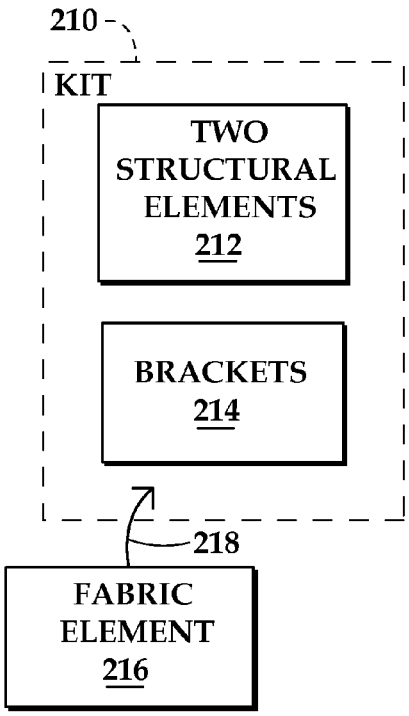
FIG. 22 shows a second version of a kit 210 that is packaged for sale and use by a purchaser for connecting two watercrafts together.

FIG. 22 shows a second version of a kit 210 that is packaged for sale and use by a purchaser for connecting two watercrafts together. The kit 210 includes at least two structural elements 212 that may be adjustable. The kit 210 may also include brackets 214. Although fabric 216 may be packaged and sold separately, the kit 210 may also include the fabric as suggested by the arrow 218.

Figure 23:
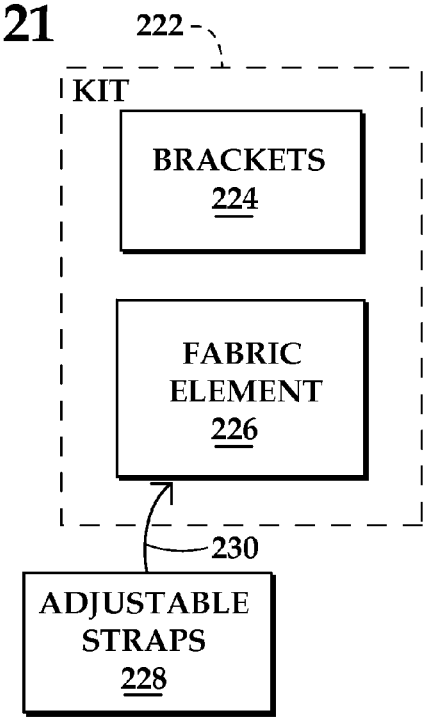
FIG. 23 shows a second version of a kit 210 that is packaged for sale and use by a purchaser for connecting two watercrafts together.

FIG. 23 shows a third version of a kit 222 that is packaged for sale and use by a purchaser for connecting two watercrafts together. The kit 222 includes brackets 224 attachable by the user to the watercrafts and that, once attached to the watercraft, are attachable to respective ends of structural elements when extended between the watercrafts so the two watercrafts are fixedly separated. The kit 222 may also include a fabric element 226 connectable to the two watercrafts along opposite edges of the fabric. The fabric may be stretchable by the user into a platform configuration with the fabric entirely above a waterline between the watercrafts when the watercrafts are fixedly separated. Or the fabric may be draped by the user into a hammock configuration between the watercraft when fixedly separated with part of the fabric below the waterline.

The kit 222 may further include adjustable straps that may already assembled so as to be part of the fabric and extending within sleeves in or on the fabric to the opposite edges thereof and connectable to the two watercrafts to accommodate the fabric being stretchable into the platform configuration with the fabric entirely above a waterline between the watercrafts, or the fabric being drapeable into the hammock configuration between the watercraft with part of the fabric below the waterline. On the other hand, the straps 228 may be sold separately to a purchaser and assembled into the fabric 226 by the purchaser so as to thread through preformed sleeves in the fabric.

I claim:

1. A kit for connecting two watercrafts together comprising:

two structural elements extendable between the two watercrafts and connectable at respective ends thereof to the watercrafts so the two watercrafts are fixedly separated, and a fabric connectable to the two watercrafts along opposite edges of the fabric, the fabric being both stretchable tightly into a taut platform configuration with the fabric entirely above a waterline between the watercrafts when the watercraft are fixedly separated and floating in a body of water, and drapeable into a loosely hanging hammock configuration between the watercraft when fixedly separated and floating in the body of water with part of the fabric below the waterline, wherein the loosely hanging hammock configuration provides ease of entry into the body of water and ease of exit from the body of water for a swimmer.

2. The kit of claim 1, further comprising brackets attachable to the watercrafts and that, once attached to the watercraft, are attachable to respective ends of the structural elements when extended between the watercrafts so the two watercrafts are fixedly separated.

3. The kit of claim 1, wherein the structural elements are adjustable to accommodate different distances between watercrafts so as to stretch the fabric into the taut platform configuration at one distance and to drape the fabric into the loosely hanging hammock configuration at another distance.

4. The kit of claim 1, further comprising adjustable straps extending within the fabric to the respective ends thereof and connectable to the two watercrafts to accommodate the fabric being stretchable into the taut platform configuration with the fabric entirely above the waterline between the watercrafts, and the fabric being drapeable into the loosely hanging hammock configuration between the watercraft with part of the fabric below the waterline.

5. A kit for connecting two watercrafts together comprising:

two structural elements extendable between the two watercrafts and connectable at respective ends thereof to the watercrafts so the two watercrafts are fixedly separated, and brackets attachable to the watercrafts and that, once attached to the watercrafts, are attachable to the respective ends of the structural elements when extended between the watercrafts so the two watercrafts are fixedly separated when floating on a body of water, wherein the structural elements are adjustable to accommodate a hammock extended between watercrafts at different distances including a taut platform configuration at one fixed distance and a loosely hanging hammock configuration at another fixed distance, wherein the loosely hanging hammock configuration provides ease of entry into and exit from the body of water for a swimmer.

6. The kit of claim 5, further comprising a fabric connectable to the two watercrafts along opposite edges of the fabric, the fabric being both stretchable tightly into the taut platform configuration with the fabric entirely above a waterline between the watercrafts when the watercrafts are fixedly separated at the one fixed distance, and drapeable into the loosely hanging hammock configuration between the watercraft when fixedly separated at the other fixed distance with part of the fabric below the waterline; and adjustable straps extending within the fabric to the respective ends thereof and connectable to the two watercrafts to accommodate the fabric being tightly stretchable into the taut platform configuration with the fabric entirely above a waterline between the watercrafts, and the fabric being drapeable into the loosely hanging hammock configuration between the watercraft with part of the fabric below the waterline.

7. A kit for connecting two watercrafts together comprising:

brackets attachable to the watercrafts and that, once attached to the watercraft, are attachable to respective ends of structural elements when extended between the watercrafts so the two watercrafts are fixedly separated; and a fabric connectable to the two watercrafts along opposite edges of the fabric, the fabric being both stretchable tightly into a taut platform configuration with the fabric entirely above a waterline between the watercrafts when the watercraft are fixedly separated and floating on a body of water, and drapeable into a loosely hanging hammock configuration between the watercraft when fixedly separated with part of the fabric below the waterline, wherein the hammock configuration provides ease of entry into and exit from the body of water for a swimmer.

8. The kit of claim 7, further comprising adjustable straps extending within the fabric to the opposite edges thereof and connectable to the two watercrafts to accommodate the fabric being tightly stretchable into the taut platform configuration with the fabric entirely above a waterline between the watercrafts, and the fabric being drapeable into the loosely hanging hammock configuration between the watercraft with part of the fabric below the waterline.

9. Method, comprising:

attaching two or more personal watercrafts together by means of structural bars, and connecting a fabric between the two watercrafts with links such that the fabric is extendable below water in a hammock configuration of the fabric to allow for an ease of entry into and exit from the water for a swimmer, and such that the fabric is stretchable tightly between the watercrafts, to provide an above water platform configuration of the fabric.

10. The method of claim 9, further comprising adjusting the structural bars to effect different distances between watercrafts.

11. Apparatus, comprising:

two or more personal watercrafts connected together by means of structural bars; and a fabric connected between the two watercrafts with links such that the fabric is extendable below water in a hammock configuration of the fabric to allow for an ease of entry into and exit from the water for a swimmer, and such that the fabric is stretchable tightly between the watercrafts, to provide an above water platform configuration of the fabric.

12. The apparatus of claim 11, wherein the structural bars are adjustable to effect different distances between watercrafts.

13. The apparatus of claim 11, wherein the links comprise hooks.

14. The apparatus of claim 11, wherein the links comprise straps.

15. The apparatus of claim 11, wherein the links comprise hooks and straps.

16. The kit of claim 1, wherein the two structural elements are connectable either at shore or while in deep water.

17. The kit of claim 5, wherein the two structural elements are connectable either at shore or while in deep water.

18. The kit of claim 7, wherein the brackets are attachable to the respective ends of the structural elements either at shore or while in deep water.

* * * * *